US006520375B2

(12) United States Patent
Youn

(10) Patent No.: US 6,520,375 B2
(45) Date of Patent: Feb. 18, 2003

(54) MEDIA DISPENSER

(75) Inventor: Ki Cho Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/984,312

(22) Filed: Oct. 29, 2001

(65) Prior Publication Data

US 2002/0050679 A1 May 2, 2002

(30) Foreign Application Priority Data

Nov. 1, 2000 (KR) ..... 00-64722
Nov. 1, 2000 (KR) ..... 00-64723

(51) Int. Cl.[7] ..... B65H 1/00
(52) U.S. Cl. ..... 221/197; 271/262
(58) Field of Search ..... 221/2, 7, 9, 13, 221/33, 92, 197, 258; 271/262, 263, 265.04

(56) References Cited

U.S. PATENT DOCUMENTS 5,848,789 A * 12/1998 Ochi et al. ..... 271/258.01
6,040,923 A * 3/2000 Takashimizu et al. ..... 358/498

* cited by examiner

*Primary Examiner*—Kenneth W. Noland
(74) *Attorney, Agent, or Firm*—Fleshner & Kim, LLP

(57) ABSTRACT

A media dispenser capable of simplifying structure and reducing cost by driving a whole system using a driving means and treating various kinds of media by installing various kinds of media selectively thus to broaden the usefulness, comprising a base plate in which a media cassette in which media are stored and a rejected box are loaded, a media pickup part installed at the lower side of the base plate for discharging the media stored in the media cassette by separating sheet by sheet, a media feeding part for feeding the media discharged through the media pickup part, a media discharging part for discharging the fed media through the media feeding part to outside, a driving means installed at one side of the base plate for generating driving force, a power transmitting means for transmitting the driving force generated at the driving means to the media pickup part, media feeding part and media discharging part, a clutch means installed at one side of the media pickup part for controlling the driving force transmitted to the media pickup part from the power transmitting part and a media rejection means for separating and collecting abnormal media among media fed to the media feeding part.

18 Claims, 5 Drawing Sheets

MEDIA DISPENSER

BACKGROUND OF THE INVENTION

1. Field of the Invention

The present invention relates to a dispenser and particularly, to a media dispenser capable of driving a whole system and using various kinds of media.

2. Description of the Background Art

A conventional media dispenser comprises a media cassette in which media are stored, a feeding module 204 to which the media stored in the media cassette 202, a sensing unit 206 sensing whether two sheets of media are fed together by sensing the thickness of the media fed through the feeding module 204, a delivery module 208 for transmitting the media passed through the thickness sensing unit 206 to a user and a reject box 210 for collecting media when two sheets of media are fed together in the thickness sensing unit 206.

In the media cassette 202, a media separating part 212 for separating media into each sheet to transmit the stored media into the feeding module 204 respectively.

Here, the media separating part 212 is connected to the first driving motor 214 installed at one side of the feeding module 204 and is operated by receiving a driving force of the first driving motor 214.

The feeding module 204 feeds the media transmitted from the media cassette 202 to the thickness sensing unit 206 and is composed of a plurality of pulleys 216, belts 218 and a plurality of rollers 220.

If the thickness sensing unit 206 senses the thickness of the media fed through the feeding module 204 and if two sheets of media are fed together, it feeds media to the reject box.

The delivery module 208 has a discharging part 222 to supply the media passed through the thickness sensing unit 206 to the user and it collects the media in case two sheets of inferior media are fed together and feeds the media to the reject box 210 via a specific process. Such delivery module 208 comprises a plurality of pulleys 226, belts 224 and a plurality of rollers 228.

The pulleys and belts of the feeding module 204 and delivery module 208 are driven by the second driving motor 230 installed at one side of the delivery module 208. Namely, the second driving motor 230 is connected with a driving pulley 232 and the driving pulley 232 is connected to the driven pulley 236 and belt 234. The driven pulley 236 is connected to each pulley by the belt and transmits the driving force.

In the conventional media dispenser, the media stored in the media cassette 202 are separated to sheet by sheet by the media separating part 212 and transmitted to the feeding module 204 if the first driving motor 214 is driven. If the second driving motor 230 is driven the feeding module 204 and the delivery module 208 are driven. Then the media transmitted to the feeding module 204 are fed to the thickness sensing unit 206 by the plurality of pulleys and belts and transmitted to the delivery module 208 after the thickness sensing unit 206 senses whether two sheets of media are passed together.

The media fed to the delivery module 208 are fed to the discharging part 222 which is capable of providing the media to the user by the plurality of rollers and belts and inferior media or media in case two or more sheets of media are transmitted are collected to the reject box 210.

However, the conventional media dispenser requires the first driving motor for driving the media separating part to separate the media from the media cassette and the second driving motor for driving the feeding module and the delivery module. Namely, there is a problem due to using a plurality of motors of relatively high cost.

Also, since the conventional media dispenser can load only one media cassette, predetermined kinds of media can be loaded and since different kinds of media can not be treated, usefulness is reduced and there is a disadvantage that an additional media dispenser is needed to treat different kinds of media.

SUMMARY OF THE INVENTION

Therefore, an object of the present invention is to provide a media dispenser capable of reducing cost and simplifying structure by driving a whole system using a driving means.

Another object is to provide a media dispenser capable of treating various kinds of media by installing various kinds of media selectively thus to broaden the usefulness.

To achieve these and other advantages and in accordance with the purpose of the present invention, as embodied and broadly described herein, there is provided a media dispenser comprising a base plate in which a media cassette in which media are stored and a rejected box are loaded, a media pickup part installed at the lower side of the base plate for discharging the media stored in the media cassette by separating sheet by sheet, a media feeding part for feeding the media discharged through the media pickup part, a media discharging part for discharging the fed media through the media feeding part to outside, a driving means installed at one side of the base plate for generating driving force, a power transmitting means for transmitting the driving force generated at the driving means to the media pickup part, media feeding part and media discharging part, a clutch means installed at one side of the media pickup part for controlling the driving force transmitted to the media pickup part from the power transmitting part and a media rejection means for separating and collecting abnormal media among media fed to the media feeding part.

The dispenser in accordance with the present invention further includes a plurality of sub media cassette units installed at one side of the base plate for loading driving force from the driving means, storing the media different from those stored in the media cassette and discharging them through the media discharging part.

The base plate has an interior loading space for loading the media cassette at the front side, another interior loading space for loading a reject box for loading inferior media at the upper side of the above interior loading space and a door at the front side of the two interior loading spaces.

A locking system for preventing an arbitrary external access is installed at the door.

A cushion member abutted on the front surface of the media cassette for buffering impact or vibration generated when the media are discharged from the media cassette is installed on the inner side surface of the door.

The driving means is a driving motor installed at one side of the base plate for generating rotational force.

The power transmitting means comprises a driven pulley connected by a driving pulley and driving belt, which are installed in a driving motor, a lower connection pulley connected by the driven pulley and timing belt, for driving the media pickup part and media feeding part and an eject pulley wound by the driven pulley and timing belt, for driving the media feeding part and media discharging part.

The media pickup part comprises a pickup roller positioned at the lower side of the base plate, for discharging the media stored in the media cassette in the lower direction by friction, a feeding roller and separating roller positioned at the lower side of the pickup roller, for feeding the media discharged by the pickup roller by separating the media sheet by sheet and a guide member for guiding the media fed through the feeding roller and separating roller to the upper direction.

The pickup roller separates and discharges the media using friction of the media and accordingly is formed to receive power from the feeding roller due to having a rubber part at a certain part of the circumferential surface.

The separating roller rotates in the same direction as the feeding roller and is connected to the feeding roller and a connection belt.

The guide member is formed to have a certain curvature at the lower side of the feeding roller and the separating roller and a connection guide for guiding the media passed through the guide member to the media feeding part at the end portion of the guide member.

The connection guide has one side surface abutted to the guide member, slopping upward and another surface for guiding the media fed from the sub media cassette unit formed upright.

The clutch means is positioned on the identical shaft as the feeding roller of the media pickup part and connected with the lower connection pulley to connect or disconnect driving force transmitted from the feeding roller based on the on/off of power supply.

The media feeding part comprises a first feeding belt wound between a first feeding roller which is positioned on the identical shaft as the lower connection pulley and a second feeding roller, rotating by receiving rotational force from the lower connection pulley and a second feeding belt positioned under the condition of being abutted to the first feeding belt and wound between a third feeding roller which is positioned on the identical shaft as the eject pulley and a fourth feeding roller positioned at the lower side of the base plate, rotating by receiving rotational force from the lower eject pulley.

The media discharging part comprises a first discharging roller which is positioned on the identical shaft as the eject pulley and rotates, a second discharging roller which is positioned having certain intervals to the rear side of the first discharging roller and a discharging belt wound between the first discharging roller and the second discharging roller.

The media rejection means comprises a reject box loaded at the front side of the base plate, for storing inferior media and a diverter installed on the media feeding route, for collecting the inferior media in the reject box.

The sub media cassette unit comprises a case installed at the lower side of the base plate, for loading a sub media cassette, an upper connection pulley connected to the lower connection pulley which is installed at the base plate by a connection belt, for receiving power, a sub lower connection pulley which is connected to the upper connection pulley by a timing belt, a sub media pickup part connected with the sub lower connection pulley, for transmitting the media stored in the sub media cassette by receiving rotational force and a sub media feeding part for transmitting the media transmitted from the sub media pickup part to the media feeding part by guiding the media to the upper direction.

The sub media feeding part comprises a sub first feeding belt wound between a sub first feeding roller which is positioned on the identical shaft as the upper connection pulley and a sub second feeding roller which is positioned on the identical shaft as the sub lower connection pulley and a sub second feeding belt positioned under the condition of being abutted to the first feeding belt and wound between a third feeding roller connected with the connection pulley and a fourth feeding roller, thus to rotate.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
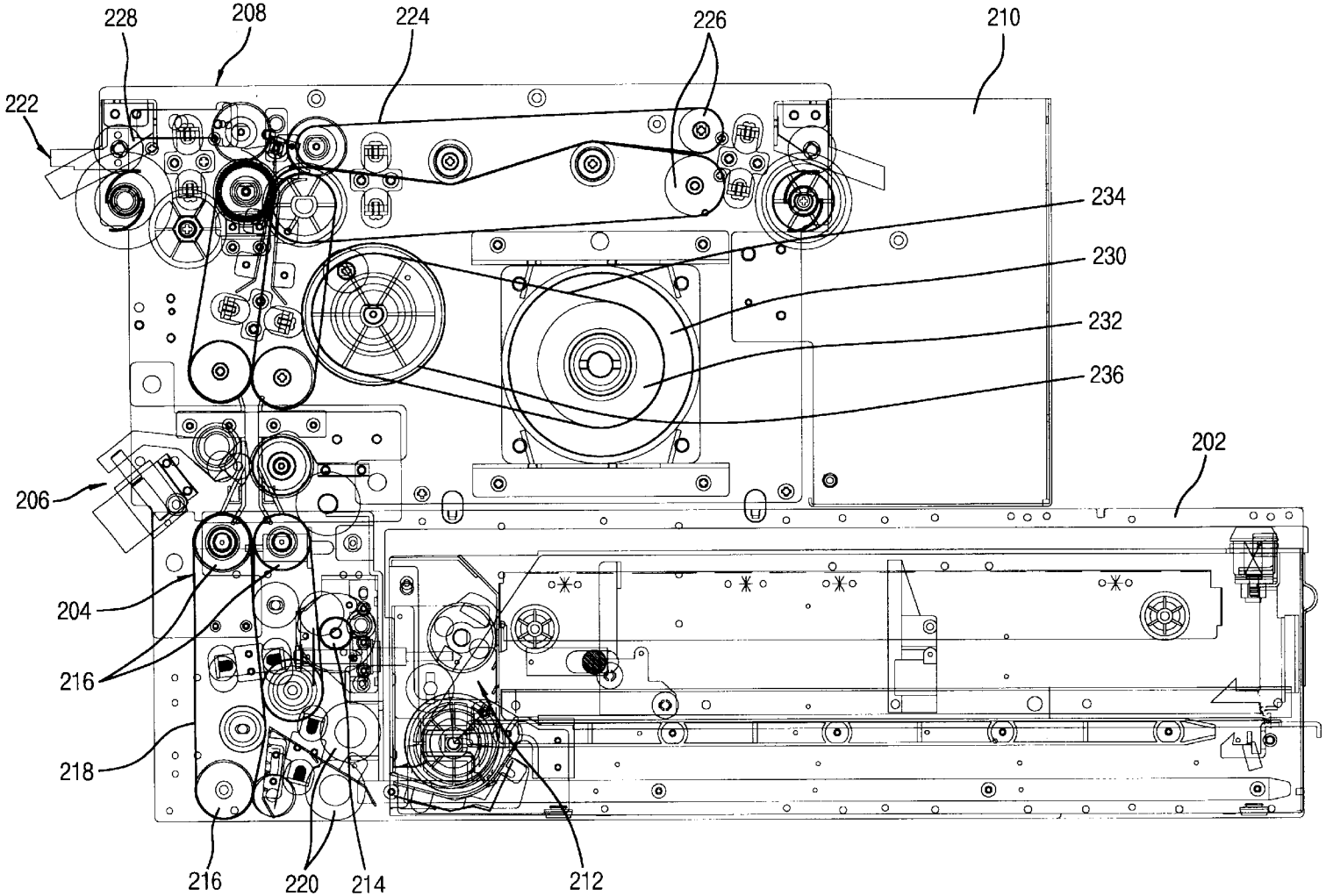
FIG. 1 BACKGROUND ART
FIG. 1 is a block diagram of a conventional media dispenser.
Figure 2:
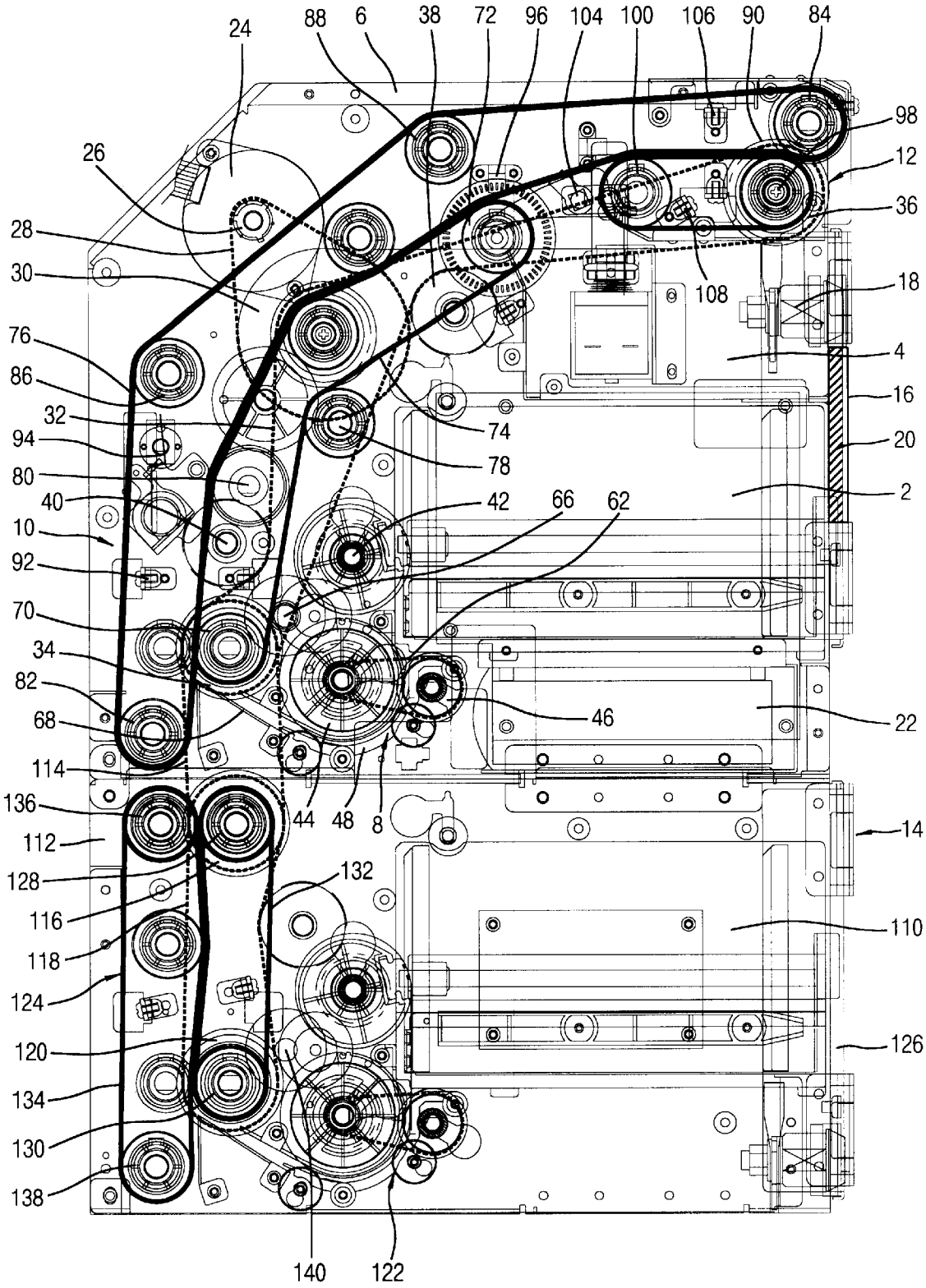
FIG. 2 is a block diagram of a media dispenser in accordance with the present invention.
Figure 3:
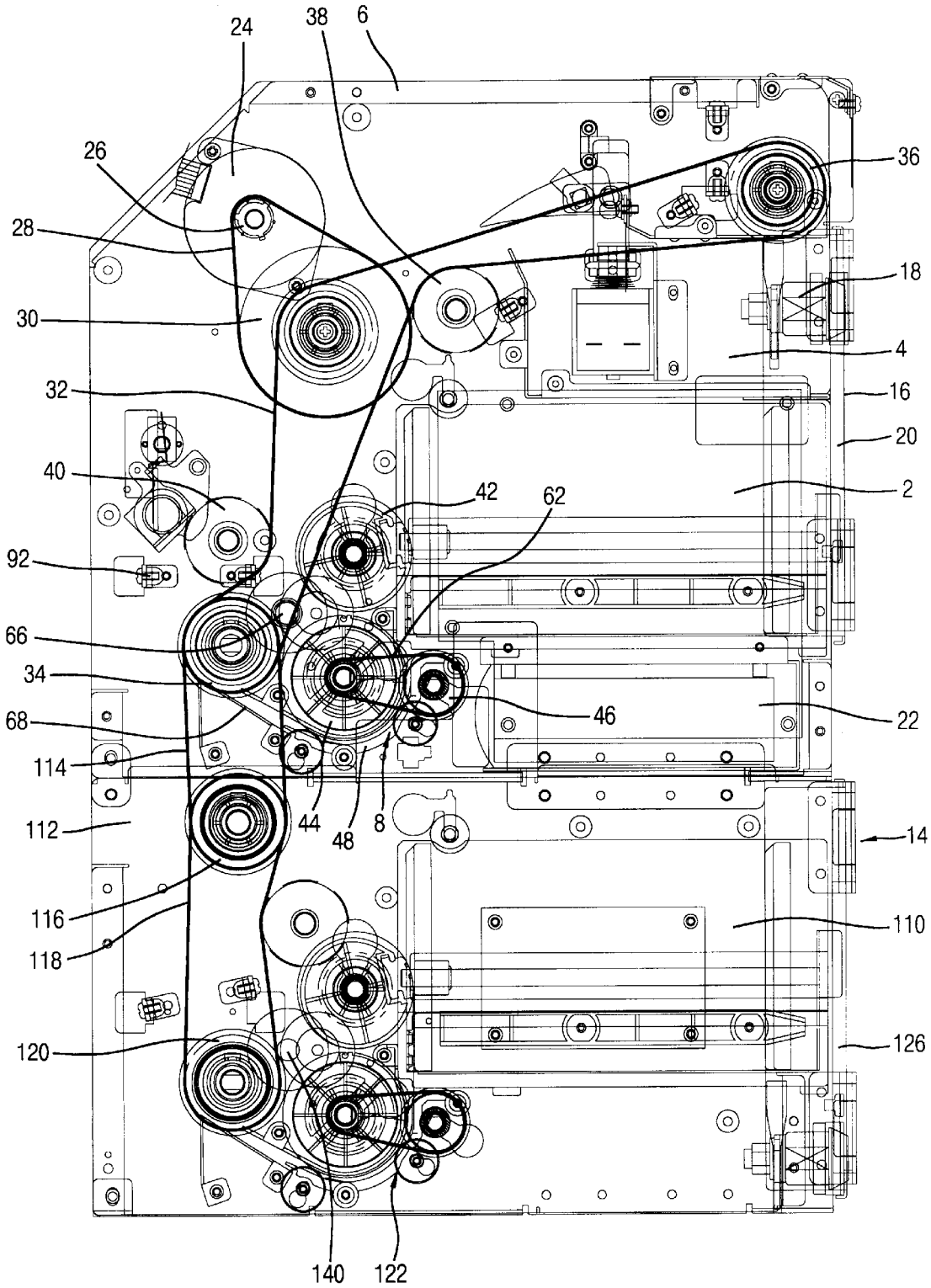
FIG. 3 is a side view showing a power transmitting system of the media dispenser in accordance with the present invention.

FIG. 2 is a block diagram of a media dispenser in accordance with the present invention.

The media dispenser in accordance with the present invention comprises a base plate 6 in which a media cassette 2 in which media are stored and a rejected box 4 for collecting inferior media are loaded, a media pickup part 8 installed at the lower side of the base plate 6 for discharging the media stored in the media cassette 2 by separating the media sheet by sheet, a media feeding part 10 for feeding the media discharged through the media pickup part, a media discharging part 12 for discharging the fed media through the media feeding part 12 to outside, a driving means installed at one side of the base plate for generating driving force, a power transmitting means for transmitting the driving force generated at the driving means to the media pickup part, media feeding part and media discharging part, a clutch means installed at one side of the media pickup part for controlling the driving force transmitted to the media pickup part from the power transmitting part and a media rejection means for separating and collecting abnormal media among media fed to the media feeding part.

In case a user extends the cassette to use another kinds of media, a sub media cassette unit 14 is additionally installed at the lower side of the base plate 6.

The base plate 6 has a interior loading space for loading the media cassette 2 at the front side, another interior loading space for loading a reject box 4 for loading inferior media at the upper side of the above interior loading space and a door 16 installed at the front side of the two interior loading spaces.

A locking system 18 is installed in the door 16 to prevent an arbitrary external access to the media cassette 2 and the reject box 4. On the inner surface of the door 16, a cushion member 20 abutted on the front surface of the media cassette 2 for buffering impact is installed.

Namely, the media cassette 2 and reject box 4 are loaded at the front side of the base plate 6, the door 16 is installed on the front surface movably and the door 16 having the locking system 18 can prevent an arbitrary external access to the media cassette 2 and the reject box 4.

The cushion member 20 abutted on the inner side surface of the door buffers impacts generated when the media are discharged from the media cassette 2.

A power board 22 for using the power supplied from outside in overall components of the media dispenser directly is installed at the lower side of the position where the media cassette of the base plate 6 is loaded.

It is desirable that the driving means is a driving motor 24 installed at one side of the base plate 6 for generating rotational force. A driving pulley 26 is installed in the driving motor.

As shown in FIG. 2, the above power transmitting means transmits power generated in the driving motor 24 to each part. A driving pulley 26 of the driving motor is connected to a driven pulley 30 by a driving belt 28 and power transmitted to the driven pulley. A timing belt 32 is wound on the driven pulley 30, a lower connection pulley 34 is wound at the lower end of the timing belt 32 and a eject pulley 36 is wound at the upper end of the timing belt 32.

A plurality of tension pulleys 38 and 40 for maintaining tension of the timing belt 32 are installed at one side of the timing belt 32.

The above lower connection pulley 34 transmits the rotational force generated by the rotation of the timing belt 32 to the media pickup part 8 and also to the sub media in case the sub media cassette unit 14 is added to the base plate 6 to use another media.

The lower connection pulley 34 connected to the media feeding part transmits the rotational force to the media feeding part.

Figure 4:
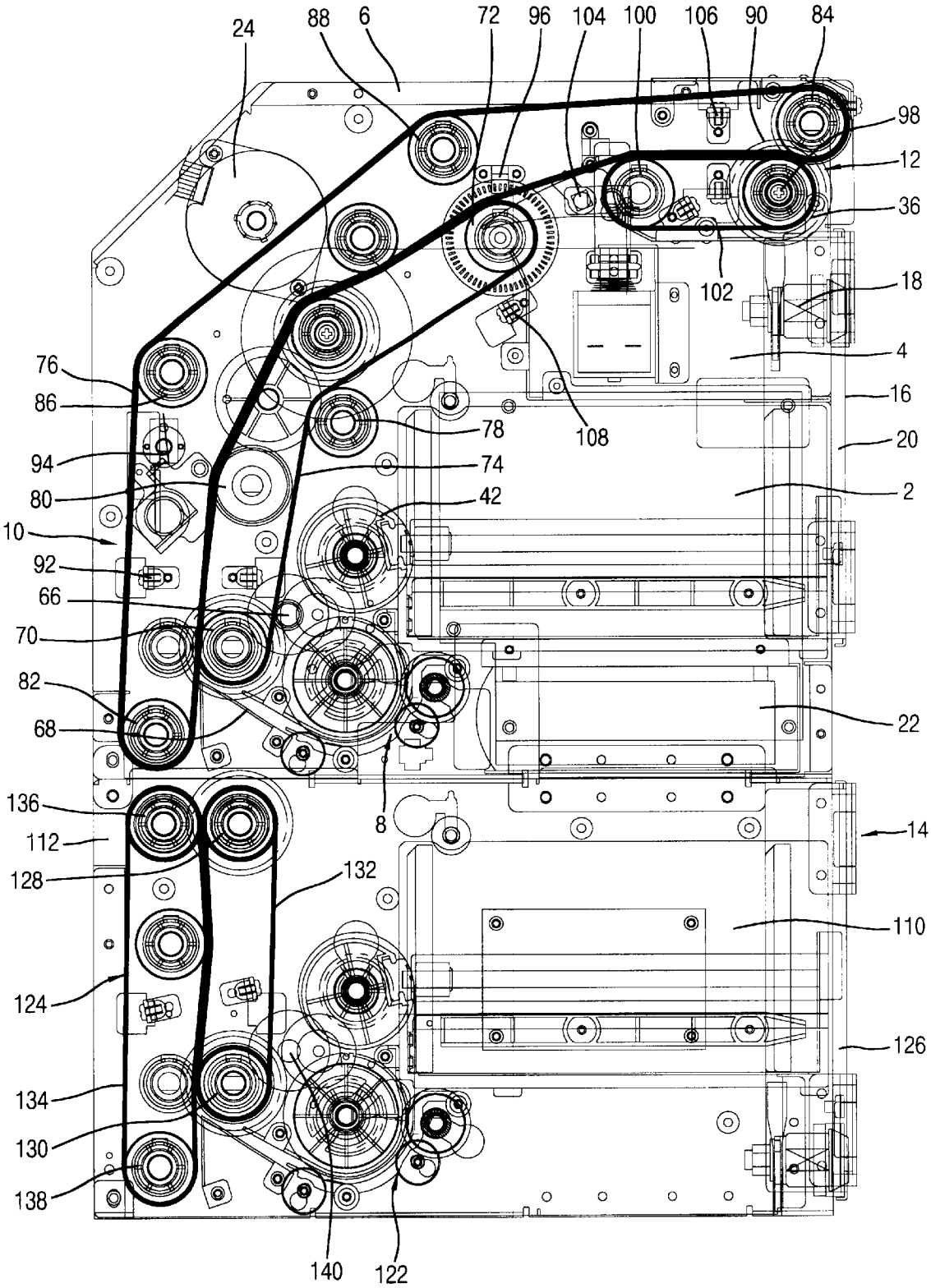
FIG. 4 is a block diagram of a media feeding channel of the media dispenser in accordance with the present invention.
Figure 5:
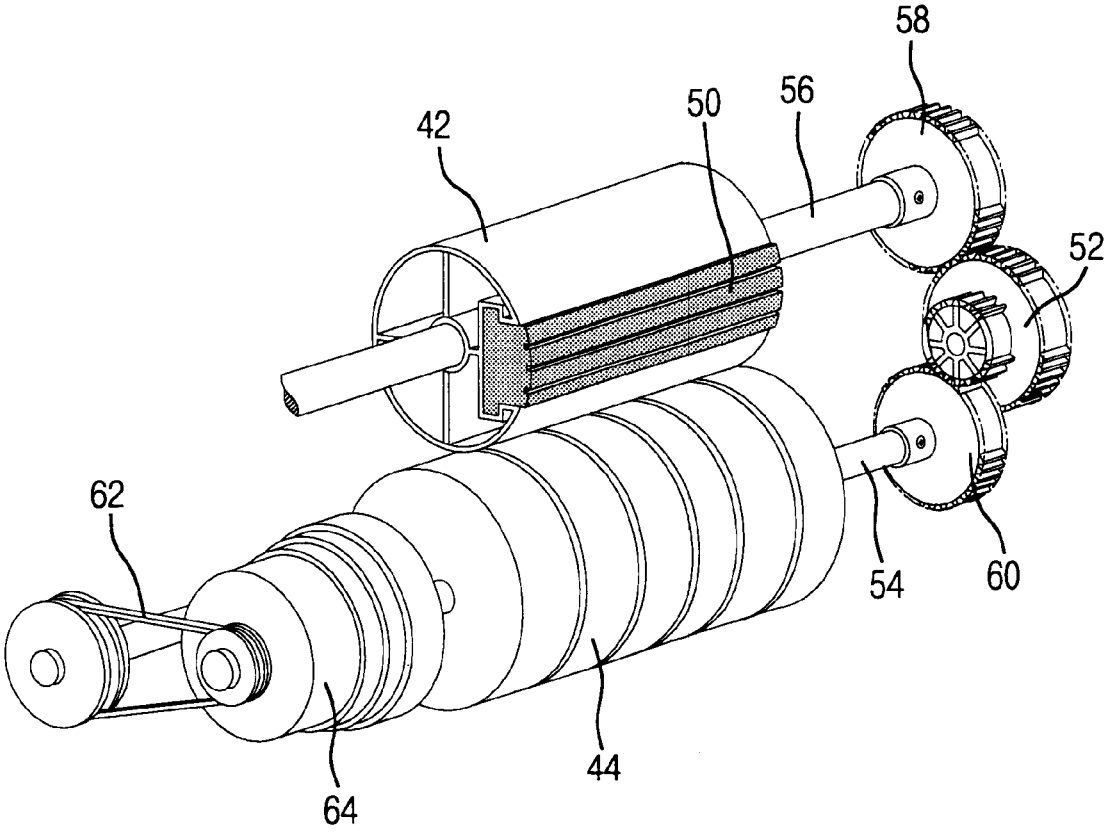
FIG. 5 is a perspective view showing a media pickup part of the media dispenser in accordance with the present invention.

FIG. 4 is a block diagram of a media feeding channel of the media dispenser in accordance with the present invention and FIG. 5 is a perspective view showing a media pickup part of the media dispenser in accordance with the present invention.

The media pickup part 8 for discharging the media cassette by separating sheet by sheet, comprises a pickup roller 42 positioned at the rear side of the media cassette 2, for discharging the media stored in the media cassette 2 to the lower direction by friction, a feeding roller 44 and separating roller 46 positioned at the lower side of the pickup roller 42, for feeding the media discharged by the pickup roller 42 by separating the media sheet by sheet and a guide member 48 for guiding the media fed through the feeding roller 44 and separating roller 46 to the upper direction.

The pickup roller 42 is positioned at the rear side of the media cassette 2 rotatably and a rubber part 50 is formed on a certain part of the circumferential surface. Accordingly, the rubber part 50 rubs with the media, discharges the media by separating and receives power in gear with the feeding roller 44.

Namely, a driving gear 60 and a driven gear 58 are installed on the rotation shafts 54 and 56 of the feeding roller and the pickup roller and an idle gear 52 is in gear between the driving gear 60 and driven gear 58 thus to transmit the rotational force of the feeding roller 44 to the pickup roller 42.

The feeding roller 44 and the separation roller 46 rotate in the identical direction under the condition of being abutted to each other to transmit the media discharged by the pickup roller 42 therebetween by separating the media sheet by sheet and are connected to the connection belt 62 thus to rotate in the identical direction.

Here, a clutch means 64 for controlling power which is transmitted from the above lower connection pulley 34 to the feeding roller 44 is installed in the feeding roller 44. Namely, the clutch means 64 is installed on the identical shaft as the feeding roller 44 and connected in gear with the lower connection pulley 34 by a clutch gear 66, to transmit or intercept power transmitted from the lower connection pulley 34 to the feeding roller 44.

The above clutch means 64 is used the solenoid method to transmit power in case power supply is approved and intercept power in case power supply is intercepted. On the contrary, the solenoid method to intercept power in case power supply is approved and transmit power in case power supply is intercepted.

The clutch means 64 installed between the lower connection pulley 34 at the driving side and the feeding roller 44 at the driven side can be applied to every method for controlling power.

The guide member 48 for guiding the media passed through the feeding roller 44 and the separation roller 46 upwardly is installed having a certain curvature at the lower side of the feeding roller 44 and the separation roller 46. A connection guide 68 is installed at one side of the guide member 48.

The connection guide 68 guides the media fed from the guide member 48 to the upper direction and has one portion connected with the guide member 48 slope upwardly and another portion connected with the sub media cassette unit 14 form upright to guide the media fed from the sub media cassette unit 14.

Such media pickup part 8 transmits the rotational force of the lower connection pulley 34 to the feeding roller 44 when the clutch means 64 is on. Then the separation roller 46 wound on the feeding roller 44 and the separation roller 46 rotates and the pickup roller 42 in gear with the feeding roller 44 rotates together. Then, as the pickup roller 42 rotates, the rubber part 50 of the pickup roller 42 discharges the media downwardly by being rubbed with the media. The media discharged by the pickup roller 42 are separated passing through between the feeding roller 44 and the separation roller 46 and the separated media move upwardly along the guide member 48 and are guided to the media feeding part 10.

When the clutch means is turned off, power transmitted from the lower connection pulley 34 to the feeding roller 44 is intercept, thus to stop the media pickup operation.

According to on/off of the clutch means, the media pickup part 8 performs pickup/pickup halting operation repeatedly.

The media feeding part 10 for guiding the media discharged through the media pickup part 8 to the media discharging part 12, comprises a first feeding belt 74 wound between a first feeding roller 70 which is positioned on the identical shaft as the lower connection pulley 34 and a second feeding roller 72 positioned at the upper side and a second feeding belt 76 positioned under the condition of being abutted to the first feeding belt 74, which is rotated to feed the media.

The first feeding belt 74 is wound between the first feeding roller 70 which is positioned on the identical shaft as the above lower connection pulley 34 and the second feeding roller 72, rotating by receiving rotational force from the above lower connection pulley 34 and a plurality of guide rollers 78 and 80 for guiding the media are installed at one side of the first feeding belt 74 rotatably.

The second feeding belt 76 positioned under the condition of being abutted to the outer surface of the first feeding belt 74 rotates in the same direction of the first feeding belt 74 and is wound between the third feeding roller 82 which is positioned at the lower side of the base plate 6 rotatably and the fourth feeding roller 84 positioned at the upper front end of the base plate 6.

A plurality of guide rollers 86 and 88 for guiding the second feeding belt 76 are positioned at one side.

Here, the fourth feeding roller 84 is positioned on the identical shaft as a gear 90 in gear with the lower connection pulley on which the timing belt 32 is wound and receives the rotational force thus to drive the above second feeding belt 76.

In the above media feeding part 10, when the driving motor 24 is driven, the timing belt 32 rotates and accordingly, the lower connection pulley 34 and the eject pulley 36 rotate. Then, the first feeding roller 70 positioned on the identical shaft as the lower connection pulley 34 rotates and has the first feeding belt rotate. The fourth feeding roller 84 in gear with the eject pulley 36 rotates and has the second feeding belt 76 rotate.

Then, the media discharged through the above media pickup part 8 pass through between the first feeding belt 74 and the second feeding belt 76 and are guided to the media discharging part 12.

The media discharging part 12 discharges the media fed from the media feeding part 10 to the user and the media discharging part 12 comprises the first discharging roller 98 which is positioned on the identical shaft as the eject pulley 36 and rotates and the second discharging roller 100 connected to the first discharging roller 98 by the discharging belt 102. The discharging belt 102 under the condition of being abutted to the upper side of the second feeding belt 76 is rotated in the same direction and discharges the media to outside.

The media rejection means senses and collects the media in case inferior data are generated while the data are fed through the media feeding part 10 or in case two sheets of media are fed together and the media rejection means comprises the reject box 4 loaded at the front side of the base plate, for storing inferior media and the diverter 104 installed between the first feeding belt 74 and the discharging 102, for collecting the inferior media in the reject box 4.

The media dispenser in accordance with the present invention, comprises a feed sensor 92 installed at one side of the media feeding part 10, for sensing passing of the media thus to turn off the clutch means 64 and counting the media, a thickness sensor 94 for sensing the thickness of the media, an eject sensor 106 for sensing the media ejected to the media discharging part 12 transmitting signals which turn on the clutch means, a reject sensor 108 installed in the reject box 4, for counting collected inferior media and a slit sensor 96 for sensing the number of the rotation of the driving motor 24 and the length of the media together with the feed sensor 92, thus to control the operation of the media dispenser.

The sub media cassette unit 14 is positioned at the lower side of the base plate 6 to collect and supply media with different size from the media cassette 2 loaded in the base plate 6.

The sub media cassette unit 14 comprises a case 112 installed at the lower side of the base plate, for loading a sub media cassette 110, an upper connection pulley 116 connected to the connection belt 114 of the lower connection pulley 34 which is installed at the base plate 6, for receiving power, a sub lower connection pulley 120 which is connected to the upper connection pulley 116 by a timing belt 118, a sub media pickup part 122 connected with the sub lower connection pulley 120, for transmitting the media stored in the sub media cassette 110 by receiving rotational force and a sub media feeding part 124 for transmitting the media transmitted from the sub media pickup part 122 to the media feeding part 10 by guiding the media to the upper direction.

The case 112 is formed in a structure that the upper side of the case can be positioned at the lower side of the base plate 6 and an interior space for loading the sub media cassette 110 is formed at the front side of the case 112. A door 126 for protecting the sub media cassette 110 is positioned on the front surface of the sub media cassette 110.

The power transmission process of the sub media cassette unit 14 will be described as follows. The upper connection pulley 116 positioned at the upper side of the lower connection pulley 34 and the case 112, which are positioned at the lower side of the base plate 6 is wound by the connection belt 114 thus to transmit the rotational force. The upper connection pulley 116 is connected to the sub lower connection pulley 120 and the timing belt 118, which are positioned at the lower side f the case 112 and rotate together.

Since the sub media pickup part 122 is formed in an identical structure as the media pickup part described above and operated in the same way, the description is omitted.

The sub media feeding part 124 feeds the media fed through the sub media pickup part 122 to the upper direction and the sub media feeding part 124 includes a sub first feeding roller 128 which is positioned on the identical shaft as the upper connection pulley 116, a second feeding roller 130 which is positioned on the identical shaft as the sub lower connection pulley 120, a sub first feeding belt 132 wound between a sub first feeding roller 128 and a second feeding roller 130 and a sub second feeding belt 134 positioned under the condition of being abutted to the first feeding belt 132.

The sub second feeding belt 134 is wound between the sub third feeding roller 136 and the sub fourth feeding roller 138 and the sub third feeding roller 136 is in gear with the upper connection pulley 116 and receives the rotational force.

Such sub media cassette unit 14 can be used attached with many units according to the need of the user. Namely, if another additional sub media cassette units are positioned on the lower surface of the sub media cassette unit 14, three sheets of media cassette can be used.

Operation of the media dispenser in accordance with the present invention with the above composition will be described as follows.

Firstly, a case of using a single media will be described.

If the driving motor 24 is operated, the driven pulley 30 connected to the driving motor 24 and the driving belt 28 rotates and the eject pulley 36 and the lower connection pulley 34 which are connected to the driven pulley 30 and the timing belt 32 rotate respectively.

The rotational force of the lower connection pulley 34 is transmitted to the first feeding belt and selectively transmitted to the media pickup part 8 through the clutch means 64. The rotational force of the eject pulley 36 is transmitted to the media discharging part 12 and the second feeding belt 76.

If the clutch means 64 is turned on and the power of the lower connection pulley 34 is transmitted to the media pickup part 8, the feeding roller 44 rotates, the separation roller 46 connected with the feeding roller 44 by the connection belt 62 rotates and the pickup roller 42 in gear with the feeding roller 44 rotates.

If the pickup roller 42 rotates, the media stored in the media cassette 2 rubs with the rubber part 50 of the pickup roller, are fed to the lower direction, are separated sheet by sheet passing through between the feeding roller 44 and the separation roller 46 and are guided to the upper direction by the guide member 48 and the connection guide 68.

The media are fed to the media discharging part 12 by the rotation of the first feeding belt 74 and the second feeding belt 76.

Here, the first feeding belt 74 is wound between the first feeding roller 70 which is positioned on the identical shaft as the above lower connection pulley 34 and the second feeding roller 72 positioned at the upper side of the base plate 6 and rotates by receiving rotational force from the above lower connection pulley 34.

The second feeding belt 76 wound between the third feeding roller 82 which is in gear with the eject pulley 36 and the fourth feeding roller 84 positioned at the lower side of the base plate 6, receives the rotational force.

The feed sensor 92 installed at one side of the media feeding part 10 senses passing of the media thus to turn off the clutch means 64 and counts the media, if the media are fed due to the rotation of the first and second feeding belt.

At this time, if the clutch means is turned off, the driving forced transmitted to the media pickup part 8 is blocked and accordingly, media feeding operation of the media cassette 2 is interrupted.

The media passed through the feed sensor 92 pass through the thickness sensor 94. The thickness sensor senses the thickness of the media and check whether the media is composed of a sheet.

The slit sensor 96 senses the number of the rotation of the driving motor 24 by sensing the rotation speed of the first feeding belt 74 and senses the length of the media according to electric signals allowed from the feed sensor 92.

The media fed from the media feeding part 10 are discharged by the media discharging part 12. Namely, the discharging belt 102 which is wound between the first discharging roller 98 which is positioned on the identical shaft as the eject pulley 36 and rotates and the second discharging roller 100, rotates and the discharging belt 102 and the second feeding belt 76 rotate under the condition that the upper parts of the discharging belt 102 and the second feeding belt 76 are abutted to each other, thus to discharge the media therebetween.

The eject sensor 106 positioned in the media discharging part 12 senses the media discharged to the media discharging part 12 and transmits a signal to turn on the clutch means 64.

Then the media pickup part 8 is driven again and performs media feeding operation.

The media are fed from the media pick part at a certain interval according to the on/off of the above clutch means 64.

The diverter 104 collects the media to the reject box 4 in case inferior media are fed or a plurality of media are fed simultaneously in discharging media.

Namely, if it is judged that the media are fed under the condition that many sheets of media are piled up according to the signal approved from the slit sensor 96 and the feed sensor 92, power supply is allowed to the solenoid and the diverter 104 converts the feeding process of the media to the reject box 4 rotating, thus to collect the media.

At this time, the reject sensor 108 positioned at one side of the reject box 4 counts the inferior media by sensing the inflow of the inferior media to the reject box 4 and interrupts the operation of the diverter 104.

Second, the process of discharging of the media stored in the sub media cassette 110 of the sub media cassette unit will be described as follows.

In case the user is willing to discharge the media stored in the sub media cassette selectively, the media feeding in the media pickup part 8 is intercepted by turning off the clutch means positioned in the median pickup part 8 and turn on/off the sub clutch means 140 positioned in the sub media pickup part 122.

Namely, if the sub clutch means 140 is turned on, the media stored in the sub media cassette 110 are fed to the upper direction by the sub media pickup part 122. Since the operation of the sub media pickup part 122 is performed identically as the media pickup part 8 as described above, the description is omitted.

The media fed by the sub media pickup part 122 in the sub media cassette 110 are moved to the upper direction by the rotation of the sub first feeding belt 132 and the sub second feeding belt 134, are guided to the media feeding part 10 and are discharged through the media discharging part 12.

The sub first feeding belt 132 is wound between a sub first feeding roller 128 which is positioned on the identical shaft as the upper connection pulley 116 connected to the lower connecting pulley 34 by the connection belt 114 and a second feeding roller 130 which is positioned on the identical shaft as the sub lower connection pulley 120

The sub second feeding belt 134 in gear with the upper connection pulley 116 is wound between the sub third feeding roller 136 and the sub fourth feeding roller 138 and rotates.

As described above, the media cassette in accordance with the present invention with the above composition and operation, which is capable of simplifying structure and reducing cost by positioning a driving motor in the base plate, driving the media feeding part and media discharging part by the driving force transmitting means and selectively driving the media pickup part by the clutch means so that a whole system is driven with a driving motor.

Also, by installing the a plurality of sub media in which media with different sizes are loaded at the lower side of the base plate, the user can discharge media with a preferable size and accordingly, one media dispenser can treat various kinds of media thus to broaden the usefulness.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A media dispenser, comprising:

a base plate in which a media cassette in which media are stored and a rejected box are loaded;

a media pickup part installed at the lower side of the base plate for discharging the media stored in the media cassette by separating sheet by sheet;

a media feeding part for feeding the media discharged through the media pickup part;

a media discharging part for discharging the fed media through the media feeding part to outside;

a driving means installed at one side of the base plate for generating driving force;

a power transmitting means for transmitting the driving force generated at the driving means to the media pickup part, media feeding part and media discharging part;

a clutch means installed at one side of the media pickup part for controlling the driving force transmitted to the media pickup part from the power transmitting part; and a media rejection means for separating and collecting abnormal media among media fed to the media feeding part.

2. The dispenser of claim 1, further comprising:

a plurality of sub media cassette units installed at one side of the base plate for receiving driving force from the driving means, storing the media different from those stored in the media cassette and discharging them through the media discharging part.

3. The dispenser of claim 1, wherein the base plate has an interior loading space for loading the media cassette at the front side, another interior loading space for loading a reject box for loading inferior media at the upper side of the above interior loading space and a door at the front side of the two interior loading spaces.

4. The dispenser of claim 3, having a locking system for preventing an arbitrary external access in the door.

5. The dispenser of claim 3, wherein a cushion member abutted on the front surface of the media cassette for buffering impact or viabration gernerated when the media are discharged from the media cassette on the inner side surface of the door is installed.

6. The dispenser of claim 1, wherein the driving means is a driving motor installed at one side of the base plate for generating rotational force.

7. The dispenser of claim 1, wherein the power transmitting means comprises:

a driven pulley connected by a driving pulley and driving belt, which are installed in a driving motor;

a lower connection pulley connected by the driven pulley and timing belt, for driving the media pickup part and media feeding part; and an eject pulley wound by the driven pulley and timing belt, for driving the media feeding part and media discharging part.

8. The dispenser of claim 1, wherein the media pickup part comprises:

a pickup roller positioned at the lower side of the base plate, for discharging the media stored in the media cassette in the lower direction by friction;

a feeding roller and separating roller positioned at the lower side of the pickup roller, for feeding the media discharged by the pickup roller by separating the media sheet by sheet; and a guide member for guiding the media fed through the feeding roller and separating roller to the upper direction.

9. The dispenser of claim 8, wherein the pickup roller separates and discharges the media using friction of the media and accordingly is formed to receive power from the feeding roller due to having a rubber part at a certain part of the circumferential surface.

10. The dispenser of claim 8, wherein the separating roller rotates in the same direction as the feeding roller and is connected to the feeding roller and a connection belt.

11. The dispenser of claim 8, wherein the guide member is formed to have a certain curvature at the lower side of the feeding roller and the separating roller and a connection guide for guiding the media passed through the guide member to the media feeding part at the end portion of the guide member.

12. The dispenser of claim 11, wherein the connection guide has one side surface abutted to the guide member, slopping upward and another surface for guiding the media fed from a sub media cassette unit formed upright.

13. The dispenser of claim 1, wherein the clutch means is positioned on the identical shaft as the feeding roller of the media pickup part and connected with the lower connection pulley to connect or disconnect driving force transmitted from the feeding roller based on the on/off of power supply.

14. The dispenser of claim 1, wherein the media feeding part comprises:

a first feeding belt wound between a first feeding roller which is positioned on the identical shaft as the lower connection pulley and a second feeding roller, rotating by receiving rotational force from the lower connection pulley; and a second feeding belt positioned under the condition of being abutted to the first feeding belt and wound between a third feeding roller which is positioned on the identical shaft as the eject pulley and a fourth feeding roller positioned at the lower side of the base plate, rotating by receiving rotational force from the lower eject pulley.

15. The dispenser of claim 1, wherein the media discharging part comprises:

a first discharging roller which is positioned on the identical shaft as the eject pulley and rotates;

a second discharging roller which is positioned having certain intervals to the rear side of the first discharging roller; and a discharging belt wound between the first discharging roller and the second discharging roller.

16. The dispenser of claim 1, wherein the media rejection means comprises:

a reject box loaded at the front side of the base plate, for storing inferior media; and a diverter installed on the media feeding route, for collecting the inferior media in the reject box.

17. The dispenser of claim 2, wherein the sub media cassette unit comprises:

a case installed at the lower side of the base plate, for loading a sub media cassette;

an upper connection pulley connected to the lower connection pulley which is installed at the base plate by a connection belt, for receiving power;

a sub lower connection pulley which is connected to the upper connection pulley by a timing belt;

a sub media pickup part connected with the sub lower connection pulley, for transmitting the media stored in the sub media cassette by receiving rotational force; and a sub media feeding part for transmitting the media transmitted from the sub media pickup part to the media feeding part by guiding the media to the upper direction.

18. The dispenser of claim 17, wherein the sub media feeding part comprises:

a sub first feeding belt wound between a sub first feeding roller which is positioned on the identical shaft as the upper connection pulley and a sub second feeding roller which is positioned on the identical shaft as the sub lower connection pulley; and a sub second feeding belt positioned under the condition of being abutted to the sub first feeding belt and wound between a sub third feeding roller connected with the connection pulley and the fourth feeding roller, thus to rotate.

* * * * *